US012279643B2

(12) United States Patent
Berberian

(10) Patent No.: US 12,279,643 B2
(45) Date of Patent: Apr. 22, 2025

(54) CIGARETTE FILTER ENHANCER APPARATUS

(71) Applicant: Z BRANDS LLC, Glendale, CA (US)

(72) Inventor: Arthur Berberian, Glendale, CA (US)

(73) Assignee: Z Brands LLC, Glendale, CA (US)

( * ) Notice: Subject to any disclaimer, the term of this patent is extended or adjusted under 35 U.S.C. 154(b) by 334 days.

(21) Appl. No.: 17/866,148

(22) Filed: Jul. 15, 2022

(65) Prior Publication Data

US 2024/0016203 A1 Jan. 18, 2024

(51) Int. Cl.

| | |
|---|---|
| ***A24D 3/04*** | (2006.01) |
| ***A24D 1/00*** | (2020.01) |
| ***A24D 1/04*** | (2006.01) |
| ***A24D 3/06*** | (2006.01) |
| ***A24D 3/10*** | (2006.01) |

(52) U.S. Cl.

CPC ..... *A24D 3/048* (2013.01); *A24D 1/002* (2013.01); *A24D 1/045* (2013.01); *A24D 3/061* (2013.01); *A24D 3/10* (2013.01)

(58) Field of Classification Search

None

See application file for complete search history.

(56) References Cited

U.S. PATENT DOCUMENTS

| | | | |
|---|---|---|---|
| 4,273,142 | A | 6/1981 | Swanson et al. |
| 4,856,540 | A | 8/1989 | Jansma et al. |
| 5,685,323 | A | 11/1997 | Crooks et al. |
| 5,724,997 | A | 3/1998 | Smith et al. |
| 7,484,511 | B2 | 2/2009 | Jupe et al. |
| 9,066,541 | B2 | 6/2015 | Allen et al. |
| 9,332,786 | B2 | 5/2016 | Yokogawa et al. |
| 9,907,335 | B2 | 3/2018 | Karles et al. |
| 10,165,794 | B2 | 1/2019 | Besso et al. |
| 10,492,522 | B2 | 12/2019 | Flynn et al. |
| 10,729,171 | B2 | 8/2020 | Penrose et al. |
| 11,272,734 | B2 | 3/2022 | Grandjean et al. |
| 2004/0050396 | A1 | 3/2004 | Squeo |
| 2007/0163609 | A1 | 7/2007 | Yen |
| 2010/0108081 | A1 | 5/2010 | Blevins Joyce et al. |
| 2018/0042294 | A1* | 2/2018 | Jordil ..... A24D 1/045 |
| 2019/0124974 | A1* | 5/2019 | Dimmick ..... A24D 3/061 |
| 2020/0281258 | A1* | 9/2020 | Brice et al. ..... A24D 3/04 |
| 2021/0127732 | A1 | 5/2021 | Knight et al. |
| 2021/0169140 | A1* | 6/2021 | Hejazi ..... A24B 15/12 |
| 2021/0244076 | A1* | 8/2021 | Ferrie ..... A24B 15/302 |

* cited by examiner

*Primary Examiner* — Christopher M Rodd
*Assistant Examiner* — Ronnie Kirby Jordan
(74) *Attorney, Agent, or Firm* — Mark Terry

(57) ABSTRACT

An apparatus for attachment to a cigarette includes a cylindrical element composed of filter material and having a distal end and a proximal end, an opening on the distal end, the opening configured for accepting and releasably attaching to a filter end of the cigarette, a smoke filter located at the proximal end, the smoke filter configured for filtering smoke emanating from the cigarette, and, a flavor capsule located within the smoke filter, the flavor capsule configured for adding flavor to the smoke emanating from the cigarette. Also disclosed is a system for smoking that includes a cigarette having a filter end and the apparatus for attachment to the cigarette described above.

19 Claims, 3 Drawing Sheets

CIGARETTE FILTER ENHANCER APPARATUS

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

TECHNICAL FIELD

The technical field relates generally to the field of smoking articles and, more specifically, to apparatuses configured for accessorizing with cigarettes.

BACKGROUND

A cigarette is a narrow cylinder containing burnable material, typically tobacco, that is rolled into thin paper for smoking. The cigarette is ignited at one end, causing it to smolder, and the resulting smoke is orally inhaled via the opposite end. Cigarette smoking is the most common method of tobacco consumption. The term cigarette, as commonly used, refers to a tobacco cigarette, but the word is sometimes used to refer to other substances, such as a cannabis cigarette or an herbal cigarette.

A cigarette filter, also known as a filter tip, is a component of a cigarette, along with cigarette paper, capsules, and adhesives. Filters may be made from plastic cellulose acetate fiber, paper or activated charcoal (either as a cavity filter or embedded into the plastic cellulose acetate fibers). Macroporous phenol-formaldehyde resins and asbestos have also been used. The plastic cellulose acetate filter and paper modify the particulate smoke phase by particle retention (filtration), and finely divided carbon modifies the gaseous phase (adsorption). Filters are intended to reduce the harm caused by smoking by reducing harmful elements inhaled by smokers. Most factory-made cigarettes are equipped with a filter and those who roll their own can buy them from a tobacconist.

The current state of the art of cigarettes has not changed significantly in more than 50 years. Conventionally, the cigarette includes a cylindrical paper filled with tobacco, with the filter on the end. Today, however, advancements in technology have resulted in more efficient and higher-quality paper, tobacco, filter material, flavors, and other additives that could enhance the smoking experience, but that are not currently widely available for cigarettes.

Therefore, a need exists for improvements over the prior art, and more particularly for more efficient and versatile apparatuses for complementing, or accessorizing with, cigarettes.

SUMMARY

A smoking system and an apparatus for attachment to a cigarette are provided. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, an apparatus for attachment to a cigarette, the apparatus includes a cylindrical element composed of filter material and having a distal end and a proximal end, an opening on the distal end, the opening configured for accepting and releasably attaching to a filter end of the cigarette, a smoke filter located at the proximal end, the smoke filter configured for filtering smoke emanating from the cigarette, and, a flavor capsule located within the smoke filter, the flavor capsule configured for adding flavor to the smoke emanating from the cigarette. In another embodiment, a system for smoking includes a cigarette having a filter end and the apparatus for attachment to the cigarette described above.

BRIEF DESCRIPTION OF THE DRAWINGS

The accompanying drawings, which are incorporated in and constitute a part of this disclosure, illustrate various example embodiments. In the drawings.

DETAILED DESCRIPTION

Figure 1:
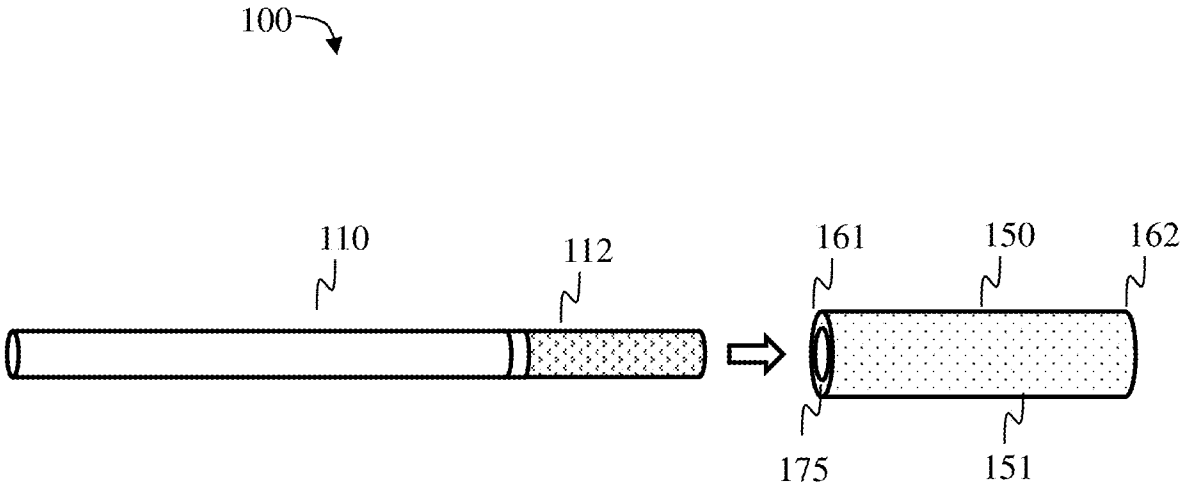
FIG. 1 is a perspective side view of a smoking system and an apparatus for attachment to a cigarette, before the apparatus has been attached to the cigarette, according to an example embodiment.

The following detailed description refers to the accompanying drawings. Wherever possible, the same reference numbers are used in the drawings and the following description to refer to the same or similar elements. While embodiments may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the claimed subject matter. Instead, the proper scope of the claimed subject matter is defined by the appended claims.

The claimed embodiments improve upon the prior art by providing an efficient and versatile apparatus for complementing, or accessorizing with, cigarettes. Specifically, the claimed embodiments provide a filter device that is easily and quickly attached to a cigarette. The claimed embodiments provide additional filtering of smoke from a cigarette, and well as add more flavor to the cigarette, thereby enhancing the smoking experience. These features of the claimed embodiments decrease the health detriments of smoking and increase the enjoyability of the smoking experience.

Referring now to the Figures, the FIGS. 1-4 illustrate a smoking system and an apparatus for attachment to a cigarette, according to an example embodiment and will be discussed together for ease of reference.

Figure 2:
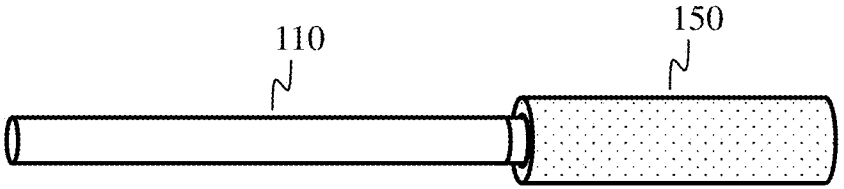
FIG. 2 is a perspective side view of the smoking system and the apparatus for attachment to a cigarette, after the apparatus has been attached to the cigarette, according to an example embodiment.

FIG. 1 is a perspective side view of the smoking system 100 and an apparatus 150 for attachment to a cigarette 110, before the apparatus has been attached to the cigarette, according to an example embodiment, while FIG. 2 shows said system and apparatus after the apparatus has been attached to the cigarette.

The smoking system 100 includes a cigarette 110 having a filter 112 on one end, as well as an apparatus 150 configured for attachment to the cigarette. The apparatus 150 includes a cylindrical element 151 composed of filter material and having a distal end 161 and a proximal end 162. The cylindrical element 151 also includes an opening 175 on the distal end 161, the opening configured for accepting and releasably attaching to the filter end 112 of the cigarette 110.

Figure 3:
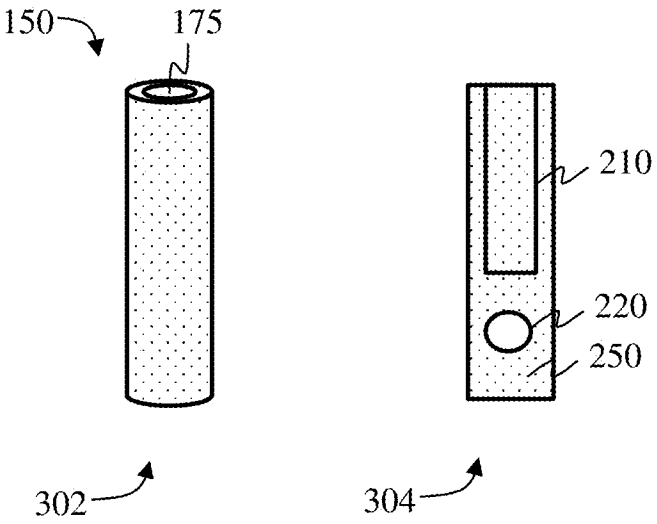
FIG. 3 shows a perspective side view and a cross sectional view of the apparatus for attachment to a cigarette, according to an example embodiment.

The cylindrical element 151 also includes a smoke filter 250 located at the proximal end 162, the smoke filter configured for filtering smoke emanating from the cigarette 110. The cylindrical element 151 also includes a flavor capsule 220 located within the smoke filter 250, the flavor capsule configured for adding flavor to the smoke emanating from the cigarette 110. The entire cylindrical element 151 may be composed of filter material such as cellulose acetate fiber. FIG. 3 shows that the flavor capsule 220 (which may be a spherical capsule) may be completely covered or completely surrounded by smoke filter 250, which serves to better ensure that the smoke emanating from the cigarette passes through or over the flavor capsule, thereby ensuring that said smoke is infused with the flavor provided by the flavor capsule.

FIG. 3 shows a perspective side view 302 and a cross sectional view 304 of the apparatus 150 for attachment to a cigarette 110, according to an example embodiment. The cross-sectional view 304 shows that the flavor capsule 220 is located within, and is surrounded by, the smoke filter 250 of the apparatus 150. The smoke filter may be composed of filter material such as cellulose acetate fiber. Also, the opening 175 on the distal end 161 may be a circular hole and may comprise filter material around its circumference. The opening 175 may comprise a circular opening sized and shaped to securely accept the filter end 112 of the cigarette 110. The opening 175 may form a friction fit with the filter end 112 of the cigarette 110 when it is inserted. The flavor capsule 220 may be comprised of water soluble food grade flavors in propylene glycol & vegetable glycerin, including well known flavors, for example menthol, maple, caramel, nuts, etc. The flavor capsule 220 may further be comprised of any combination of flavor elements such as mint, benzaldehyde, benzyl alcohol, cinnamyl alcohol, dimethyl benzyl carbinyl butanoate, ethyl butanoate, ethyl isobutanoate, ethyl maltol, furfural, furfuryl alcohol, ethyl heptanoate, limonene, beta linalool, methyl anthranilate, methyl cinnamate, menthol, raspberry ketone, methyl ether and vanillin, or the like. Also, flavoring chemicals used in cigarettes and e-cigarettes may be used in the flavor capsule, such as caffeine, diacetyl, apple oil, 2,5-dimethylpyrazine and 2,3-pentanedione.

FIG. 3 shows the cylindrical element 151 may further comprise a cylindrical void 210 within the cylindrical element 151, wherein the opening 175 provides access to the cylindrical void. The cylindrical void 210 may comprise a cylindrical shaped void that is sized and shaped to securely accept the filter end 112 of the cigarette 110. The cylindrical void 210 may form a friction fit with the filter end 112 of the cigarette 110 when it is inserted.

Figure 4:
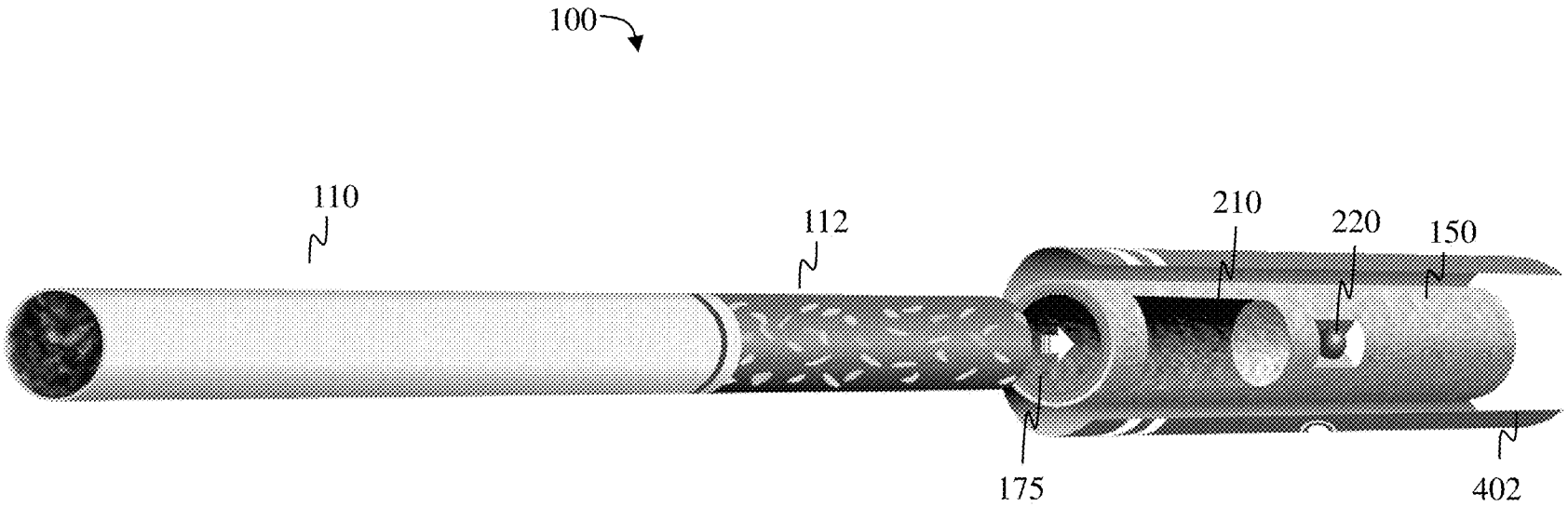
FIG. 4 is another perspective side view of a smoking system and an apparatus for attachment to a cigarette, before the apparatus has been attached to the cigarette, according to an example embodiment.

FIG. 4 is another perspective side view of the smoking system 100 and an apparatus 150 for attachment to a cigarette 110, before the apparatus has been attached to the cigarette, according to an example embodiment. FIG. 4 shows that the cylindrical element 151 also includes a flavor capsule 220 located within the smoke filter 250, the flavor capsule configured for adding flavor to the smoke emanating from the cigarette 110. The flavor capsule is configured to release flavor material when saturated with smoke from the cigarette. FIG. 4 also shows that the cylindrical element 151 may be completely covered or completely surrounded by a paper 402, which serves to provide better grip to the user and for decorative purposes.

While certain embodiments have been described, other embodiments may exist. Furthermore, although embodiments herein have been described as being associated with certain materials, the claimed embodiments may be manufactured from other types of materials.

Although the subject matter has been described in language specific to structural features, it is to be understood that the subject matter defined in the appended claims is not necessarily limited to the specific features or acts described above. Rather, the specific features and acts described above are disclosed as example forms of implementing the claims.

What is claimed is:

1. An apparatus for attachment to a cigarette, the apparatus comprising:

a) a cylindrical element composed of filter material and having a distal end and a proximal end, the cylindrical element including a cylindrical void extending from the distal end toward the proximal end;

b) an opening on the distal end of the cylindrical void, the opening configured for accepting and releasably attaching to a filter end of the cigarette via a friction fit;

c) a smoke filter located at the proximal end of the cylindrical element, the smoke filter configured for filtering smoke passing through the cylindrical void and emanating from the cigarette; and d) a flavor capsule located within and completely surrounded by the smoke filter, the flavor capsule configured for adding flavor to the smoke passing through the smoke filter and releasing flavor when exposed to smoke.

2. The apparatus of claim 1, wherein the filter material comprises cellulose acetate fiber.

3. The apparatus of claim 2, wherein the opening on the distal end comprises filter material.

4. The apparatus of claim 3, wherein the opening on the distal end comprises a circular opening sized and shaped to securely accept the filter end of the cigarette.

5. The apparatus of claim 4, wherein the opening on the distal end forms a friction fit with the filter end of the cigarette.

6. The apparatus of claim 4, wherein the opening provides access to the cylindrical void.

7. The apparatus of claim 6, wherein the cylindrical void is sized and shaped to securely accept the filter end of the cigarette.

8. The apparatus of claim 7, wherein the cylindrical void forms a friction fit with the filter end of the cigarette.

9. The apparatus of claim 8, wherein the smoke filter comprises filter material.

10. The apparatus of claim 9, wherein the flavor capsule is configured to release flavor material when saturated with smoke from the cigarette.

11. A system for smoking, comprising:

a cigarette having a filter end;

an apparatus for attachment to the cigarette, the apparatus comprising:

a) a cylindrical element composed of filter material and having a distal end and a proximal end, the cylindrical element including a cylindrical void extending from the distal end toward the proximal end;

b) an opening on the distal end of the cylindrical void, the opening configured for accepting and releasably attaching to the filter end of the cigarette via a friction fit;

c) a smoke filter located at the proximal end of the cylindrical element, the smoke filter configured for filtering smoke passing through the cylindrical void and emanating from the cigarette; and d) a flavor capsule located within and completely surrounded by the smoke filter, the flavor capsule configured for adding flavor to the smoke passing through the smoke filter and releasing flavor when exposed to smoke.

12. The system of claim 11, wherein the filter material comprises cellulose acetate fiber.

13. The system of claim 12, wherein the opening on the distal end comprises filter material.

14. The system of claim 13, wherein the opening on the distal end comprises a circular opening sized and shaped to securely accept the filter end of the cigarette.

15. The system of claim 14, wherein the opening provides access to the cylindrical void.

16. The system of claim 15, wherein the cylindrical void is sized and shaped to securely accept the filter end of the cigarette.

17. The system of claim 16, wherein the cylindrical void forms a friction fit with the filter end of the cigarette.

18. The system of claim 17, wherein the smoke filter comprises filter material.

19. The system of claim 18, wherein the flavor capsule is configured to release flavor material when saturated with smoke from the cigarette.

* * * * *